US011371206B2

(12) United States Patent
Kondo et al.

(10) Patent No.: US 11,371,206 B2
(45) Date of Patent: Jun. 28, 2022

(54) HYDRAULIC EXCAVATOR DRIVE SYSTEM

(71) Applicant: KAWASAKI JUKOGYO KABUSHIKI KAISHA, Kobe (JP)

(72) Inventors: Akihiro Kondo, Kobe (JP); Makoto Ito, Kobe (JP); Seiji Aoki, Kobe (JP); Moriyuki Sakamoto, Kobe (JP); Yoji Yudate, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/282,543

(22) PCT Filed: Sep. 4, 2019

(86) PCT No.: PCT/JP2019/034779
§ 371 (c)(1),
(2) Date: Apr. 2, 2021

(87) PCT Pub. No.: WO2020/071044
PCT Pub. Date: Apr. 9, 2020

(65) Prior Publication Data

US 2021/0372077 A1 Dec. 2, 2021

(30) Foreign Application Priority Data

Oct. 2, 2018 (JP) ..... JP2018-187512

(51) Int. Cl.
*E02F 9/22* (2006.01)
*F15B 11/17* (2006.01)
(Continued)

(52) U.S. Cl.
CPC ..... *E02F 3/425* (2013.01); *E02F 9/123* (2013.01); *E02F 9/2225* (2013.01);
(Continued)

(58) Field of Classification Search
CPC ..... F15B 11/161; F15B 11/165; F15B 11/166; F15B 11/17; E02F 9/2285; E02F 9/2292
See application file for complete search history.

(56) References Cited

U.S. PATENT DOCUMENTS 4,531,366 A * 7/1985 Moriya ..... E02F 9/2232 417/216
8,607,557 B2 * 12/2013 Ikeda ..... E02F 9/2242 60/421

(Continued)

FOREIGN PATENT DOCUMENTS

JP H10-299027 A 11/1998
JP 2005-299376 A 10/2005
JP 6235917 B2 11/2017

*Primary Examiner* — Michael Leslie
(74) *Attorney, Agent, or Firm* — Oliff PLC

(57) ABSTRACT

A hydraulic excavator drive system includes: a first pump that supplies hydraulic oil to a boom cylinder via a boom control valve, and supplies the hydraulic oil to a bucket cylinder via a first bucket control valve; a second pump that supplies the hydraulic oil to an arm cylinder via an arm control valve; a third pump that supplies the hydraulic oil to a slewing motor via a slewing control valve, and supplies the hydraulic oil to the bucket cylinder via a second bucket control valve; and a controller that moves one of the first bucket control valve and the second bucket control valve when a bucket excavating operation or a bucket dumping operation is performed concurrently with another operation, and moves both the first bucket control valve and the second bucket control valve when a bucket excavating operation is performed alone.

1 Claim, 4 Drawing Sheets

(51) Int. Cl.

| | |
|---|---|
| ***E02F 3/42*** | (2006.01) |
| ***E02F 9/12*** | (2006.01) |
| ***F15B 15/20*** | (2006.01) |

(52) U.S. Cl.

CPC ..... *E02F 9/2267* (2013.01); *E02F 9/2271* (2013.01); *E02F 9/2292* (2013.01); *F15B 11/17* (2013.01); *F15B 15/20* (2013.01); *E02F 9/2285* (2013.01); *E02F 9/2296* (2013.01); *F15B 2211/20546* (2013.01); *F15B 2211/20576* (2013.01); *F15B 2211/3116* (2013.01)

(56) References Cited

U.S. PATENT DOCUMENTS

| | | | | |
|---|---|---|---|---|
| 9,790,659 | B2 * | 10/2017 | Sugano | E02F 9/2292 |
| 9,963,856 | B2 * | 5/2018 | Takahashi | E02F 9/2296 |
| 10,330,128 | B2 * | 6/2019 | Moriki | F15B 11/10 |
| 10,364,550 | B2 * | 7/2019 | Amano | E02F 9/2004 |
| 10,385,892 | B2 * | 8/2019 | Cugati | E02F 3/404 |
| 2005/0204734 | A1 | 9/2005 | Oka | |
| 2016/0348335 | A1 | 12/2016 | Kondo et al. | |

* cited by examiner

HYDRAULIC EXCAVATOR DRIVE SYSTEM

TECHNICAL FIELD

The present invention relates to a hydraulic excavator drive system.

BACKGROUND ART

In general, a hydraulic excavator drive system includes a slewing motor, a boom cylinder, an arm cylinder, and a bucket cylinder as hydraulic actuators. These hydraulic actuators are supplied with hydraulic oil from one or two pumps. In recent years, for example, there are cases where three pumps are used for a large-sized hydraulic excavator.

For example, Patent Literature 1 discloses a hydraulic excavator drive system including first to third pumps. Specifically, the hydraulic oil is supplied from the first pump and the second pump to each of the boom cylinder and the arm cylinder via a boom control valve or an arm control valve, and the hydraulic oil is supplied to the slewing motor from the third pump via a slewing control valve. Also, the hydraulic oil is supplied from the second pump and the third pump to the bucket cylinder via bucket control valves.

To be more specific, when a bucket operation is performed concurrently with a slewing operation, the hydraulic oil is supplied to the bucket cylinder from the second pump via a first bucket control valve. On the other hand, when a bucket operation is performed without a slewing operation being performed, the hydraulic oil is supplied to the bucket cylinder from the third pump via a second bucket control valve.

CITATION LIST

Patent Literature

PTL 1: Japanese Patent No. 6235917

SUMMARY OF INVENTION

Technical Problem

For the hydraulic excavator drive system disclosed in Patent Literature 1, there is a demand to make the speed of the bucket cylinder faster.

In view of the above, an object of the present invention is to provide a hydraulic excavator drive system that makes it possible to make the speed of the bucket cylinder faster.

Solution to Problem

In order to solve the above-described problems, a hydraulic excavator drive system according to the present invention includes: a first pump that supplies hydraulic oil to a boom cylinder via a boom control valve, and supplies the hydraulic oil to a bucket cylinder via a first bucket control valve; a second pump that supplies the hydraulic oil to an arm cylinder via an arm control valve; a third pump that supplies the hydraulic oil to a slewing motor via a slewing control valve, and supplies the hydraulic oil to the bucket cylinder via a second bucket control valve; and a controller that moves one of or both the first bucket control valve and the second bucket control valve when a bucket excavating operation or a bucket dumping operation is performed concurrently with another operation, and moves both the first bucket control valve and the second bucket control valve when a bucket excavating operation is performed alone.

According to the above configuration, at least when a bucket excavating operation is performed alone, the hydraulic oil is supplied to the bucket cylinder from both the first pump and the third pump, and thereby the speed of the bucket cylinder can be made faster.

For example, the boom control valve may be a first boom control valve, and the arm control valve may be a first arm control valve. The first pump may supply the hydraulic oil to the arm cylinder via a second arm control valve. The second pump may supply the hydraulic oil to the boom cylinder via a second boom control valve. Further, the third pump may supply the hydraulic oil to the arm cylinder via a third arm control valve.

The controller may move the first arm control valve, the second arm control valve, and the third arm control valve when an arm crowding operation is performed alone, and move only the first arm control valve or the first and third arm control valves when an arm crowding operation or an arm pushing operation is performed concurrently with a boom raising operation. According to this configuration, when an arm crowding operation is performed alone, the hydraulic oil is supplied to the arm cylinder from all of the first pump, the second pump, and the third pump, and thereby the speed of the arm cylinder can be made faster.

Advantageous Effects of Invention

The present invention makes it possible to make the speed of the bucket cylinder faster.

DESCRIPTION OF EMBODIMENTS

Figure 1:
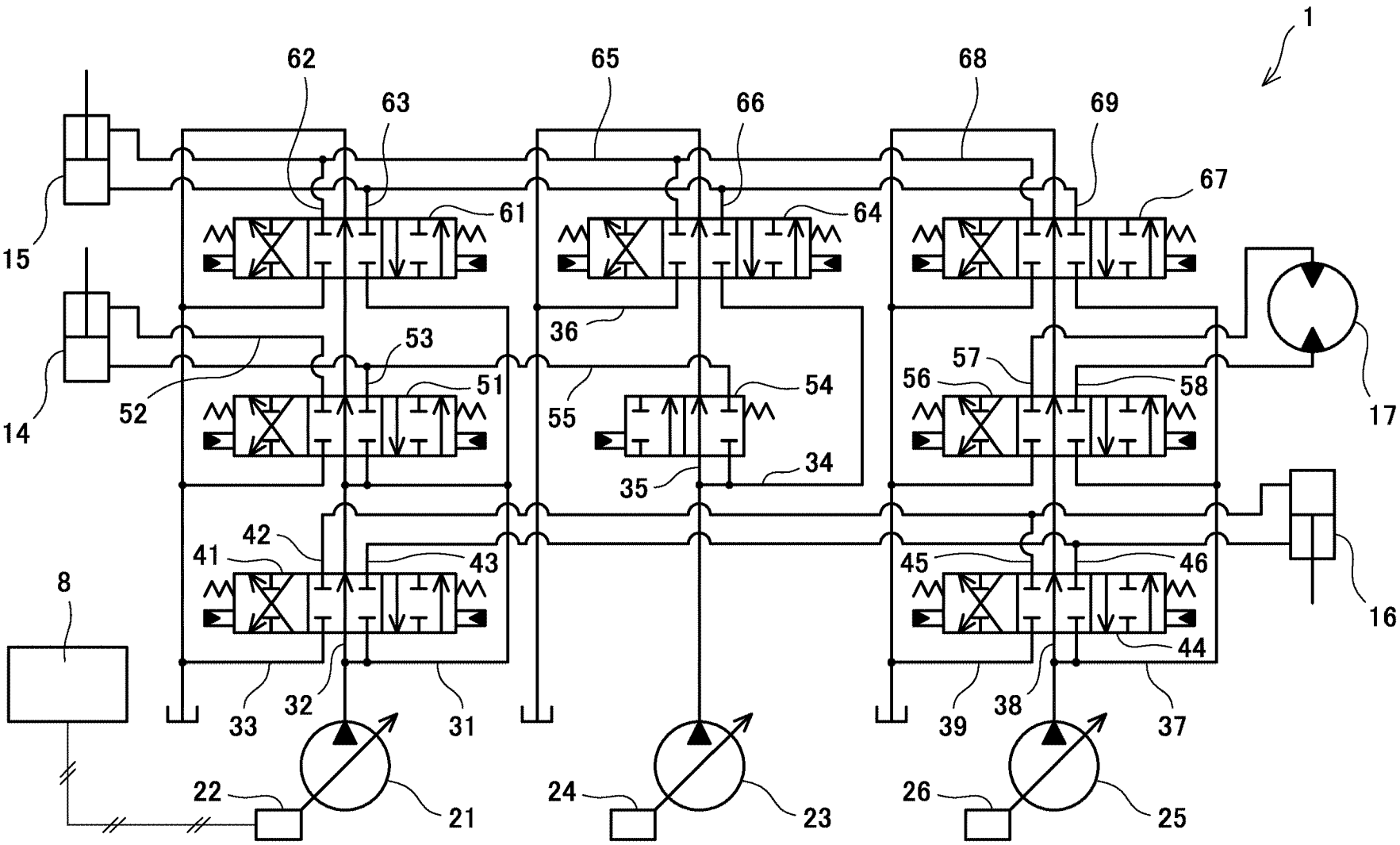
FIG. 1 is a main circuit diagram of a hydraulic excavator drive system according to one embodiment of the present invention.
Figure 2:
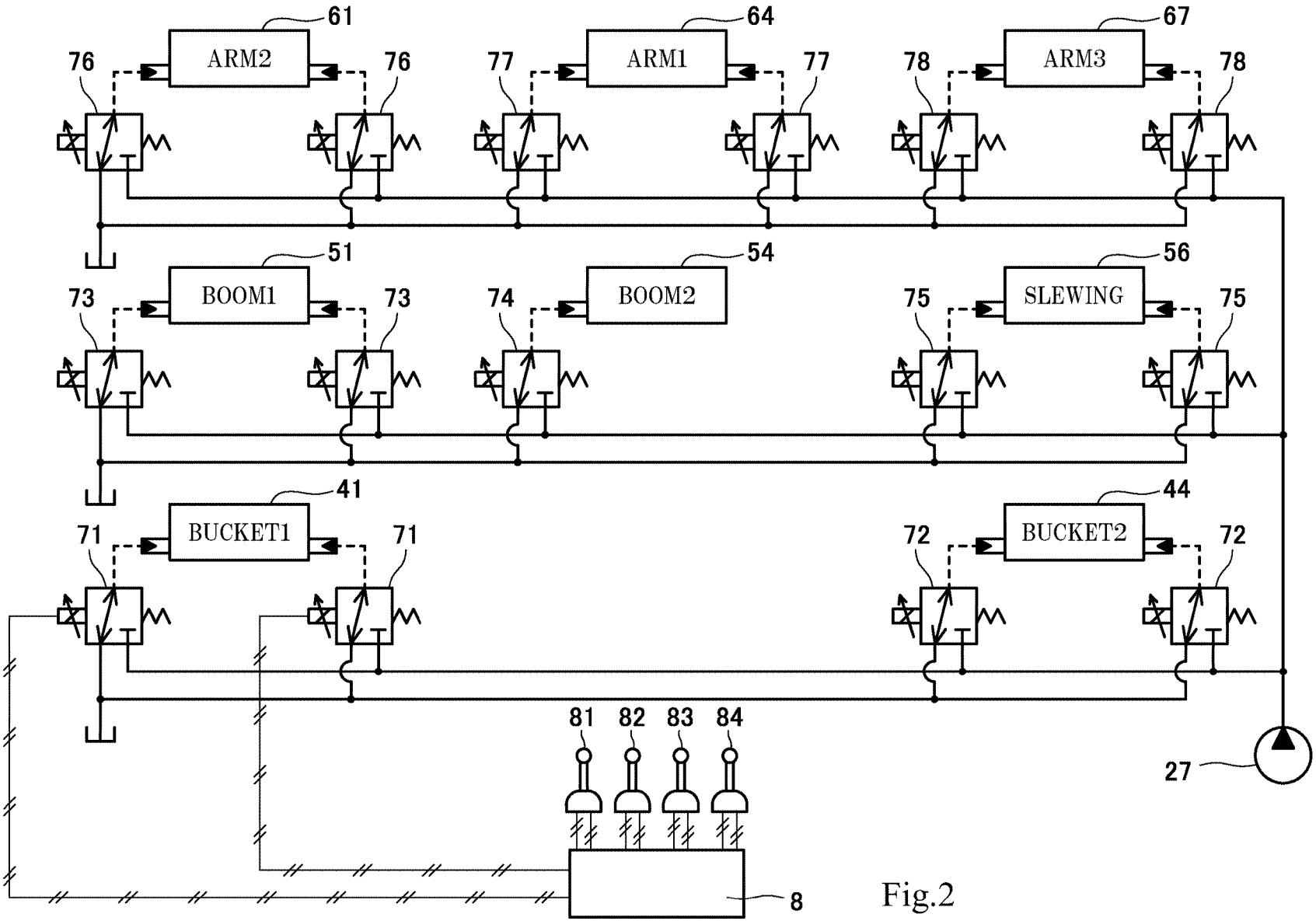
FIG. 2 is an operation-related circuit diagram of the hydraulic excavator drive system of FIG. 1.
Figure 3:
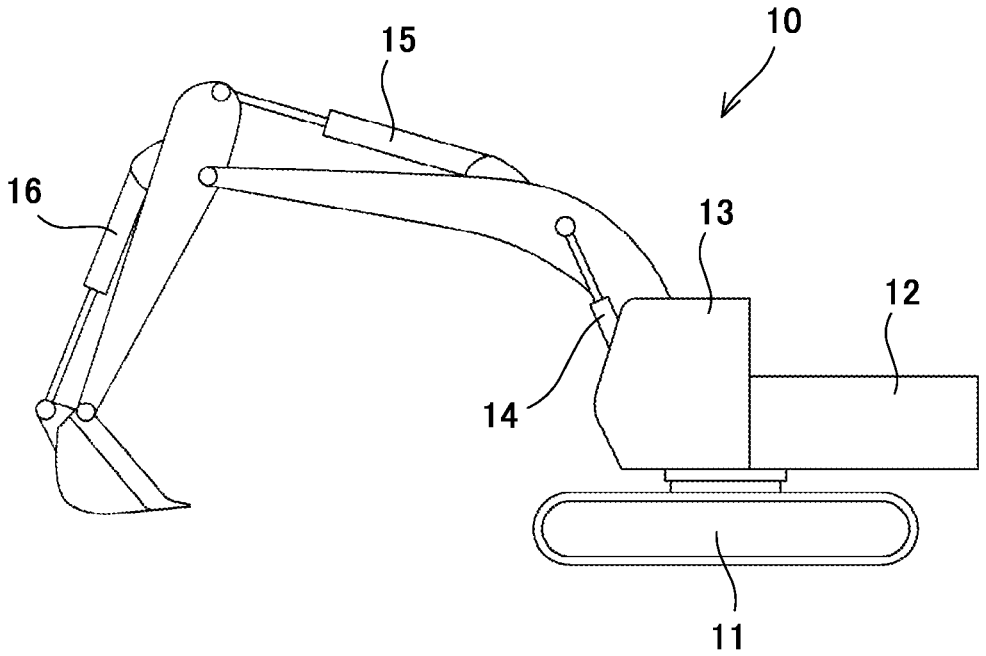
FIG. 3 is a side view of a hydraulic excavator.

FIG. 1 and FIG. 2 show a hydraulic excavator drive system 1 according to one embodiment of the present invention. FIG. 3 shows a hydraulic excavator 10, in which the drive system 1 is installed.

The hydraulic excavator 10 shown in FIG. 3 is a self-propelled hydraulic excavator, and includes a traveling unit 11. The hydraulic excavator 10 further includes a slewing unit 12 and a boom. The slewing unit 12 is slewably supported by the traveling unit 11. The boom is luffable relative to the slewing unit 12. An arm is swingably coupled to the distal end of the boom, and a bucket is swingably coupled to the distal end of the arm. The slewing unit 12 is equipped with a cabin 13. An operator's seat is installed in the cabin 13. It should be noted that the hydraulic excavator 10 need not be of a self-propelled type.

The drive system 1 includes, as hydraulic actuators, a boom cylinder 14, an arm cylinder 15, and a bucket cylinder 16, which are shown in FIG. 3, and also a slewing motor 17 shown in FIG. 1 and a pair of unshown right and left travel motors. The slewing motor 17 slews the slewing unit 12. The boom cylinder 14 tuffs the boom. The arm cylinder 15 swings the arm. The bucket cylinder 16 swings the bucket.

The drive system 1 further includes a first main pump 21, a second main pump 23, and a third main pump 25, which supply hydraulic oil to the aforementioned hydraulic actuators. The boom cylinder 14 is supplied with the hydraulic oil from the first main pump 21 and the second main pump 23 via a first boom control valve 51 and a second boom control valve 54. The arm cylinder 15 is supplied with the hydraulic oil from the second main pump 23, the first main pump 21, and the third main pump 25 via a first arm control valve 64, a second arm control valve 61, and a third arm control valve 67. The bucket cylinder 16 is supplied with the hydraulic oil from the first main pump 21 and the third main pump 25 via a first bucket control valve 41 and a second bucket control valve 44. The slewing motor 17 is supplied with the hydraulic oil from the third main pump 25 via a slewing control valve 56. Although not illustrated, each of the pair of travel motors is supplied with the hydraulic oil from the first main pump 21 or the second main pump 23 via a travel control valve. The description of the travel control valve is omitted below.

All the above-described control valves are spool valves. In the present embodiment, each of the control valves moves in accordance with a pilot pressure. Alternatively, all the control valves may be solenoid pilot-type valves. In the present embodiment, the second boom control valve 54 is a two-position valve, and the other control valves are three-position valves. That is, the second boom control valve 54 includes one pilot port, whereas each of the control valves except the second boom control valve 54 includes a pair of pilot ports. The second boom control valve 54 moves only when a boom raising operation is performed. Alternatively, the second boom control valve 54 may be a three-position valve that moves when a boom raising operation is performed and when a boom lowering operation is performed.

Specifically, the first bucket control valve 41, the first boom control valve 51, and the second arm control valve 61 are connected to the first main pump 21 by a first pump line 31. The first pump line 31 includes a shared passage and a plurality of branch passages. The shared passage connects to the first main pump 21. The plurality of branch passages are branched off from the shared passage, and connect to the first bucket control valve 41, the first boom control valve 51, and the second arm control valve 61. All the control valves connected to the first main pump 21 are connected to a tank by a tank line 33. Further, in the present embodiment, upstream of all the branch passages of the first pump line 31, a center bypass line 32 is branched off from the shared passage. The center bypass line 32 extends to the tank in a manner to pass through all the control valves connected to the first main pump 21.

The second boom control valve 54 and the first arm control valve 64 are connected to the second main pump 23 by a second pump line 34. The second pump line 34 includes a shared passage and a plurality of branch passages. The shared passage connects to the second main pump 23. The plurality of branch passages are branched off from the shared passage, and connect to the second boom control valve 54 and the first arm control valve 64. The control valves connected to the second main pump 23, except the second boom control valve 54, are connected to the tank by a tank line 36. Further, in the present embodiment, upstream of all the branch passages of the second pump line 34, a center bypass line 35 is branched off from the shared passage. The center bypass line 35 extends to the tank in a manner to pass through all the control valves connected to the second main pump 23.

The second bucket control valve 44, the slewing control valve 56, and the third arm control valve 67 are connected to the third main pump 25 by a third pump line 37. The third pump line 37 includes a shared passage and a plurality of branch passages. The shared passage connects to the third main pump 25. The plurality of branch passages are branched off from the shared passage, and connect to the second bucket control valve 44, the slewing control valve 56, and the third arm control valve 67. All the control valves connected to the third main pump 25 are connected to the tank by a tank line 39. Further, in the present embodiment, upstream of all the branch passages of the third pump line 37, a center bypass line 38 is branched off from the shared passage. The center bypass line 38 extends to the tank in a manner to pass through all the control valves connected to the third main pump 25.

The first boom control valve 51 is connected to the boom cylinder 14 by a first boom raising supply line 53 and a boom lowering supply line 52. The second boom control valve 54 is connected to the first boom raising supply line 53 by a second boom raising supply line 55.

The first arm control valve 64 is connected to the arm cylinder 15 by a first arm crowding supply line 66 and a first arm pushing supply line 65. The second arm control valve 61 is connected to the first arm crowding supply line 66 by a second arm crowding supply line 63, and connected to the first arm pushing supply line 65 by a second arm pushing supply line 62. The third arm control valve 67 is connected to the first arm crowding supply line 66 by a third arm crowding supply line 69, and connected to the first arm pushing supply line 65 by a third arm pushing supply line 68.

The first bucket control valve 41 is connected to the bucket cylinder 16 by a first bucket excavating supply line 42 and a first bucket dumping supply line 43. The second bucket control valve 44 is connected to the first bucket excavating supply line 42 by a second bucket excavating supply line 45, and connected to the first bucket dumping supply line 43 by a second bucket dumping supply line 46.

The slewing control valve 56 is connected to the slewing motor 17 by a left slewing supply line 57 and a right slewing supply line 58.

The first main pump 21, the second main pump 23, and the third main pump 25 are driven by an unshown engine. Each of the first main pump 21, the second main pump 23, and the third main pump 25 is a variable displacement pump (a swash plate pump or a bent axis pump) whose tilting angle is changeable. The tilting angle of the first main pump 21 is adjusted by a first regulator 22. The tilting angle of the second main pump 23 is adjusted by a second regulator 24. The tilting angle of the third main pump 25 is adjusted by a third regulator 26.

In the present embodiment, the delivery flow rate of each of the first main pump 21, the second main pump 23, and the third main pump 25 is controlled by electrical positive control. Accordingly, each of the first regulator 22, the second regulator 24, and the third regulator 26 moves in accordance with an electrical signal. For example, in a case where the main pump (21, 23, or 25) is a swash plate pump, the first regulator 22, the second regulator 24, or the third regulator 26 may electrically change the hydraulic pressure applied to a servo piston coupled to the swash plate of the main pump, or may be an electric actuator coupled to the swash plate of the main pump.

Alternatively, the delivery flow rate of each of the first main pump 21, the second main pump 23, and the third main pump 25 may be controlled by hydraulic negative control. In this case, each of the first regulator 22, the second regulator 24, and the third regulator 26 moves in accordance with a hydraulic pressure. Alternatively, the delivery flow rate of each of the first main pump 21, the second main pump 23, and the third main pump 25 may be controlled by load-sensing control.

A plurality of operation devices including a boom operation device 81, an arm operation device 82, a bucket operation device 83, and a slewing operation device 84 as shown in FIG. 2 are disposed in the aforementioned cabin 13. Each operation device includes an operating unit (an operating lever or a foot pedal) that receives an operation for moving a corresponding hydraulic actuator, and outputs an operation signal corresponding to an operating amount of the operating unit.

Specifically, the boom operation device 81 outputs a boom operation signal (a boom raising operation signal or a boom lowering operation signal) whose magnitude corresponds to the inclination angle of the operating lever, and the arm operation device 82 outputs an arm operation signal (an arm crowding operation signal or an arm pushing operation signal) whose magnitude corresponds to the inclination angle of the operating lever. Similarly, the bucket operation device 83 outputs a bucket operation signal (a bucket excavating operation signal or a bucket dumping operation signal) whose magnitude corresponds to the inclination angle of the operating lever, and the slewing operation device 84 outputs a slewing operation signal (a left slewing operation signal or a right slewing operation signal) whose magnitude corresponds to the inclination angle of the operating lever.

It should be noted that, among the plurality of operation devices, one pair of operation devices may be integrated together, or there may be a plurality of pairs of operation devices, in each of which the two operation devices are integrated together. For example, the boom operation device 81 and the bucket operation device 83 may be integrated together, and the arm operation device 82 and the slewing operation device 84 may be integrated together.

In the present embodiment, each operation device is an electrical joystick that outputs an electrical signal as an operation signal to a controller 8. Accordingly, the pilot ports of all the control valves are connected to solenoid proportional valves 71 to 78.

To be more specific, the pilot ports of the first boom control valve 51 are connected to a pair of solenoid proportional valves 73, and the pilot port of the second boom control valve 54 is connected to a solenoid proportional valve 74. The pilot ports of the first arm control valve 64 are connected to a pair of solenoid proportional valves 77; the pilot ports of the second arm control valve 61 are connected to a pair of solenoid proportional valves 76; and the pilot ports of the third arm control valve 67 are connected to a pair of solenoid proportional valves 78. The pilot ports of the first bucket control valve 41 are connected to a pair of solenoid proportional valves 71, and the pilot ports of the second bucket control valve 44 are connected to a pair of solenoid proportional valves 72. The pilot ports of the slewing control valve 56 are connected to a pair of solenoid proportional valves 75.

The solenoid proportional valves 71 to 78 are connected to an auxiliary pump 27. The auxiliary pump 27 is driven by an engine that drives the first main pump 21, the second main pump 23, and the third main pump 25.

In the present embodiment, each of the solenoid proportional valves 71 to 78 is a direct proportional valve whose output secondary pressure and a command current fed thereto indicate a positive correlation. Alternatively, each of the solenoid proportional valves 71 to 78 may be an inverse proportional valve whose output secondary pressure and the command current fed thereto indicate a negative correlation.

When the operating unit(s) of one or more operation devices receive an operation (or operations), the aforementioned controller 8 controls the corresponding regulator(s) (22, 24, and/or 26), such that the greater the magnitude(s) of the operation signal(s) outputted from the operation device (s), the higher the delivery flow rate(s) of the corresponding main pump(s) (21, 23, and/or 25). For example, the controller 8 is a computer that includes a CPU and memories such as a ROM and RAM. The CPU executes a program stored in the ROM.

Also, when the operating unit of each operation device receives an operation, the controller 8 controls the corresponding control valve via a solenoid proportional valve. Specifically, in accordance with increase in the magnitude of an operation signal outputted from each operation device, the controller 8 increases the amount of movement (i.e., spool stroke) of the corresponding control valve.

For example, when a boom raising operation is performed alone (i.e., when the boom operation device 81 outputs a boom raising operation signal and the other operation devices output operation signals indicating that the other operation devices are in neutral), the controller 8 moves both the first boom control valve 51 and the second boom control valve 54.

On the other hand, when a boom raising operation is performed concurrently with an arm crowding operation or an arm pushing operation, the controller 8, for the boom, moves only the first boom control valve 51 without moving the second boom control valve 54. Meanwhile, for the arm, the controller 8 moves only the first arm control valve 64, or moves the first arm control valve 64 and the third arm control valve 67, without moving the second arm control valve 61. Whether or not to move the third arm control valve 67 is determined in accordance with a ratio between the amount of the arm operation and the amount of the boom operation. Specifically, if the ratio is less than a threshold, the controller 8 does not move the third arm control valve 67, whereas if the ratio is greater than or equal to the threshold, the controller 8 moves the third arm control valve 67. Alternatively, whether or not to move the third arm control valve 67 may be determined in advance in accordance with a balance between specification values (a head diameter, a rod diameter, and a stroke amount) of the arm cylinder 15 and specification values (a head diameter, a rod diameter, and a stroke amount) of the boom cylinder 14.

When an arm crowding operation is performed alone, the controller 8 moves all of the first arm control valve 64, the second arm control valve 61, and the third arm control valve 67. On the other hand, when an arm pushing operation is performed alone, the controller 8 moves the first arm control valve 64 and the second arm control valve 61 without moving the third arm control valve 67, or moves all of the first arm control valve 64, the second arm control valve 61, and the third arm control valve 67. Whether or not to move the third arm control valve 67 when an arm pushing operation is performed alone is determined in accordance with the amount of the arm operation. Specifically, if the amount of the arm operation is less than a threshold, the controller 8 does not move the third arm control valve 67, whereas if the amount of the arm operation is greater than or equal to the threshold, the controller 8 moves the third arm control valve 67. Alternatively, whether or not to move the third arm control valve 67 may be determined in advance in accordance with specification values (a head diameter, a rod diameter, and a stroke amount) of the arm cylinder 15.

When a bucket excavating operation is performed alone, the controller 8 moves both the first bucket control valve 41 and the second bucket control valve 44. On the other hand, when a bucket dumping operation is performed alone, the controller 8 moves the first bucket control valve 41 without moving the second bucket control valve 44, or moves both the first bucket control valve 41 and the second bucket control valve 44. Whether or not to move the second bucket control valve 44 when a bucket dumping operation is performed alone is determined in accordance with the amount of the bucket operation. Specifically, if the amount of the bucket operation is less than a threshold, the controller 8 does not move the second bucket control valve 44, whereas if the amount of the bucket operation is greater than or equal to the threshold, the controller 8 moves the second bucket control valve 44. Alternatively, whether or not to move the second bucket control valve 44 may be determined in advance in accordance with specification values (a head diameter, a rod diameter, and a stroke amount) of the bucket cylinder 16.

When a bucket excavating operation or a bucket dumping operation is performed concurrently with another operation, the controller 8 moves one of or both the first bucket control valve 41 and the second bucket control valve 44. For example, when a bucket excavating operation or a bucket dumping operation is performed concurrently with a left slewing operation or a right slewing operation, the controller 8 moves the first bucket control valve 41 without moving the second bucket control valve 44. At the time, the first main pump 21 is dedicated for the bucket cylinder 16, and the third main pump 25 is dedicated for the slewing motor 17.

When a bucket excavating operation or a bucket dumping operation is performed concurrently with an arm crowding operation or an arm pushing operation, the controller 8 moves the second bucket control valve 44 without moving the first bucket control valve 41, or moves both the first bucket control valve 41 and the second bucket control valve 44. Whether or not to move the first bucket control valve 41 is determined in accordance with a ratio between the amount of the bucket operation and the amount of the arm operation. Specifically, if the ratio is less than a threshold, the controller 8 does not move the first bucket control valve 41, whereas if the ratio is greater than or equal to the threshold, the controller 8 moves the first bucket control valve 41. For the arm, the controller 8 moves the first arm control valve 64 and the second arm control valve 61 without moving the third arm control valve 67. At the time, if the ratio between the amount of the bucket operation and the amount of the arm operation is less than the threshold, the first main pump 21 and the second main pump 23 are dedicated for the arm cylinder 15, and the third main pump 25 is dedicated for the bucket cylinder 16.

Further, for example, when a bucket excavating operation or a bucket dumping operation is performed concurrently with a boom raising operation and an arm crowding operation, the controller 8 moves the second bucket control valve 44 without moving the first bucket control valve 41. For the boom, the controller 8 moves the first boom control valve 51 without moving the second boom control valve 54, and for the arm, the controller 8 moves only the first arm control valve 64 without moving the second arm control valve 61 and the third arm control valve 67. At the time, the first main pump 21 is dedicated for the boom cylinder 14; the second main pump 23 is dedicated for the arm cylinder 15; and the third main pump 25 is dedicated for the bucket cylinder 16.

As described above, in the drive system 1 of the present embodiment, at least when a bucket excavating operation is performed alone, the hydraulic oil is supplied to the bucket cylinder 16 from both the first main pump 21 and the third main pump 25, and thereby the speed of the bucket cylinder 16 can be made faster.

Also, in the present embodiment, when an arm crowding operation is performed alone, the hydraulic oil is supplied to the arm cylinder 15 from all of the first main pump 21, the second main pump 23, and the third main pump 25, and thereby the speed of the arm cylinder 15 can be made faster.

(Variations)

The present invention is not limited to the above-described embodiments. Various modifications can be made without departing from the scope of the present invention.

For example, each of the boom operation device 81, the arm operation device 82, the bucket operation device 83, and the slewing operation device 84 may be a pilot operation valve that outputs a pilot pressure as an operation signal. In this case, the solenoid proportional valves 73 for the first boom control valve 51 may be eliminated, and the pilot ports of the first boom control valve 51 may be connected to the boom operation device 81, which is a pilot operation valve. The same applies to the first arm control valve 64 and the slewing control valve 56. Even in a case where the bucket operation device 83 is a pilot operation valve, the first bucket control valve 41 is controlled via the pair of solenoid proportional valves 71. In the case of adopting a pilot operation valve, a pilot pressure outputted from the pilot operation valve is detected by a pressure sensor, and inputted to the controller 8 as an electrical signal.

Instead of each of the center bypass lines 32, 35, and 38, an unloading line that is branched off from the shared passage of the pump line (31, 34, or 37) and that extends to the tank without passing through the control valves, the unloading line being provided with an unloading valve, may be adopted.

Figure 4:
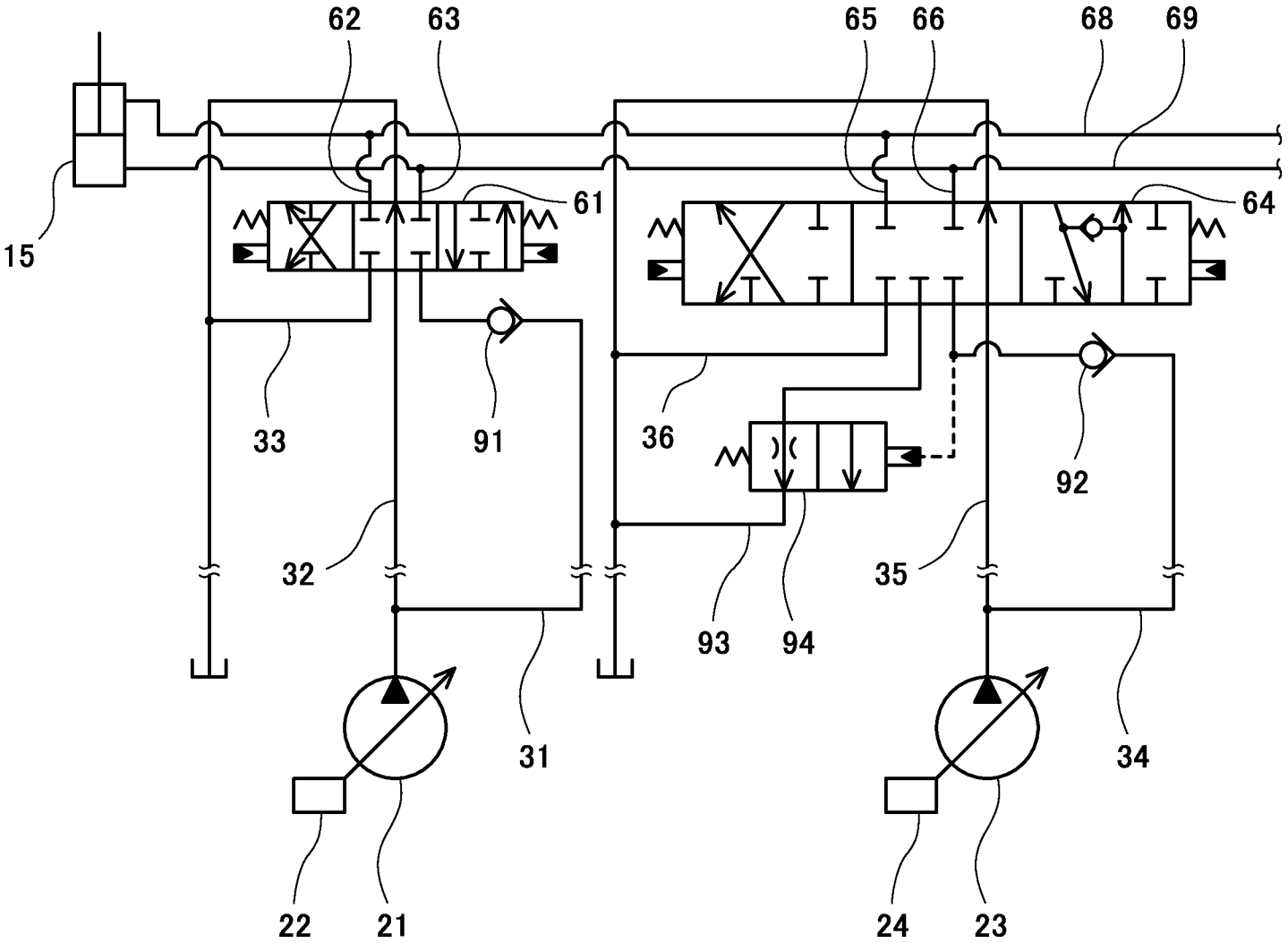
FIG. 4 is a main circuit diagram of a part of the hydraulic excavator drive system according to a variation.

Further, as shown in FIG. 4, the first arm control valve 64 may be configured to, at the time of arm crowding, cause the hydraulic oil discharged from the arm cylinder 15 through the first arm pushing supply line 65 to flow into the first arm crowding supply line 66 via a check valve. In the case of adopting such a configuration in which the hydraulic oil is regenerated, even if the third arm control valve 67 is eliminated, the speed of the arm cylinder 15 can be made fast at the time of arm crowding.

More specifically, in the configuration shown in FIG. 4, a branch passage of the first pump line 31, the branch passage being intended for the second arm control valve 61, is provided with a check valve 91. Also, a branch passage of the second pump line 34, the branch passage being intended for the first arm control valve 64, is provided with a check valve 92. The first arm control valve 64 is connected to the tank not only by the tank line 36, but also by a tank line 93. The tank line 36 is dedicated for arm pushing, and the tank line 93 is dedicated for arm crowding. The tank line 93 is provided with a variable restrictor 94, which moves in accordance with a supply pressure to the arm cylinder 15 at the time of performing an arm crowding operation.

If the third arm control valve 67 is adopted in addition to the above-described configuration in which the hydraulic oil is regenerated at the time of arm crowding, the flow rate of the regenerated hydraulic oil can be reduced, and thereby energy loss can be suppressed. It should be noted that the third arm control valve 67 may be eliminated regardless of whether or not the first arm control valve 64 is configured to regenerate the hydraulic oil at the time of arm crowding.

In a case where the third arm control valve 67 is eliminated, the second arm control valve 61 may also be eliminated. Further, regardless of whether or not the third arm control valve 67 is eliminated, the second boom control valve 54 may be eliminated.

REFERENCE SIGNS LIST

1 hydraulic excavator drive system
10 hydraulic excavator
14 boom cylinder
15 arm cylinder
16 bucket cylinder
17 slewing motor
21 first main pump
23 second main pump
25 third main pump
41 first bucket control valve
44 second bucket control valve
51 first boom control valve
54 second boom control valve
56 slewing control valve
61 second arm control valve
64 first arm control valve
67 third arm control valve
8 controller

The invention claimed is:

1. A hydraulic excavator drive system comprising:

a first pump that supplies hydraulic oil to a boom cylinder via a first boom control valve, the first pump supplies the hydraulic oil to a bucket cylinder via a first bucket control valve, and the first pump supplies the hydraulic oil to an arm cylinder via a second arm control valve;

a second pump that supplies the hydraulic oil to the arm cylinder via a first arm control valve and, the second pump supplies the hydraulic oil to the boom cylinder via a second boom control valve;

a third pump that supplies the hydraulic oil to a slewing motor via a slewing control valve, the third pump supplies the hydraulic oil to the bucket cylinder via a second bucket control valve, and the third pump supplies the hydraulic oil to the arm cylinder via a third arm control valve; and a controller that moves:

one of or both the first bucket control valve and the second bucket control valve when a bucket excavating operation or a bucket dumping operation is performed concurrently with another operation, both the first bucket control valve and the second bucket control valve when a bucket excavating operation is performed alone, the first arm control valve, the second arm control valve, and the third arm control valve when an arm crowding operation is performed alone, and only the first arm control valve or the first and third arm control valves when the arm crowding operation or an arm pushing operation is performed concurrently with a boom raising operation.

* * * * *